United States Patent [19]

Fosnaught

[11] Patent Number: 4,574,020

[45] Date of Patent: Mar. 4, 1986

[54] APPARATUS AND METHOD FOR WRAPPING A PLASTIC LABEL AROUND A CONTAINER

[75] Inventor: Harold R. Fosnaught, Perrysburg, Ohio

[73] Assignee: Owens-Illinois, Inc., Toledo, Ohio

[21] Appl. No.: 555,758

[22] Filed: Nov. 28, 1983

[51] Int. Cl.[4] ..... B65C 3/16; B65C 9/22

[52] U.S. Cl. ..... 156/80; 156/215; 156/308.6; 156/450; 156/458; 156/498; 156/521; 156/578; 156/DIG. 13; 156/DIG. 35; 118/212; 118/259

[58] Field of Search ..... 156/80, 86, 215, 308.6, 156/450, 458, 498, 521, 568, 578, DIG. 13, DIG. 35; 118/667, 212, 259

[56] References Cited

U.S. PATENT DOCUMENTS

| | | | |
|---|---|---|---|
| 3,235,433 | 2/1966 | Cvacho et al. | 156/229 |
| 3,344,222 | 9/1967 | Shapiro et al. | 156/308.6 |
| 3,468,467 | 9/1969 | Amberg | 220/72 |
| 3,648,651 | 3/1972 | Hinchcliffe et al. | 118/212 |
| 4,019,942 | 4/1977 | Kay, Jr. | 118/667 |
| 4,048,281 | 9/1977 | Brummett et al. | 156/86 |
| 4,323,416 | 4/1982 | Malthouse et al. | 156/521 |
| 4,406,721 | 9/1983 | Hoffmann | 156/86 |

*Primary Examiner*—Michael Wityshyn
*Attorney, Agent, or Firm*—John R. Nelson

[57] ABSTRACT

Apparatus and methods are disclosed for a high speed production line in which a container is wrapped with a plastic label comprising a foam polystyrene layer, there being means to move a leading edge of the label to the periphery of a rotating vacuum drum, means to apply methylene chloride to the underside of the foam layer to form finite areas on the leading label edge and a finite area on the trailing edge. The finite areas have therein a rapidly solidifying tacky solution of the foam polymer in methylene chloride, the tacky viscous solutions rapidly solidifying to form an adhesive bond. The solvent-applied label is quickly moved to a label wrapping station where it is wrapped around a container, the finite areas on the leading edge tacking the label to the container, and the finite area on the trailing edge forming a cohesive bond on the seam formed by the overlapped label ends.

10 Claims, 8 Drawing Figures

APPARATUS AND METHOD FOR WRAPPING A PLASTIC LABEL AROUND A CONTAINER

The present invention relates to apparatus and methods for wrapping plastic labels around a container on a continuous production basis.

It has been known to utilize mechanical handling apparatus to supply labels to a container. Such apparatus has included a plastic label sheet feed supply, a drum upon which the label is secured and which moves the label into engagement with the outer surface of a container. The label adheres to the container and is subsequently wrapped around the container by rolling it along a fixed surface. U.S. Pat. No. 4,323,416, for instance, shows such an apparatus, the label being glued to the container and its overlapped ends glued together by the use of a glue application assembly. Hot-melt adhesives have been used to secure the labels to the container and to form a glued side seam when applied to the overlapped label ends.

The use of the hot-melt adhesive (glue) has been messy and expensive, heat being required to heat the adhesive. There is a hazard of being exposed to possible burning from heaters used to heat the glue or the heated glue itself. In addition, such as in the case of an oriented plastic container, the label cannot be easily removed from the container and hence the body portion of the container is contaminated and cannot be readily recycled.

It is an object of the present invention to provide apparatus and methods for quickly and efficiently applying plastic labels to a container on a production basis without using a hot-melt adhesive with its resultant drawbacks.

It is an object of the present invention to provide an apparatus for wrapping around a container a plastic sheet label comprising a foam polymer layer having a top side and an underside, the underside of the foam layer being next to the container, the apparatus comprising: means to provide a web of the plastic label sheet continuously toward a label-wrapping station in which the sheet has a width that approximately equals the axial dimension of the label when wrapped around the container and the label having an outside surface with label indicia thereon, means to move a leading edge of the sheet to a vacuum drum having ports on the periphery communicating with the interior of the drum, means for cutting a desired length of material from the sheet to form a label for one container, means for pulling a vacuum on the interior of the drum to pull the label to the drum periphery, means for applying a solvent for the polymer of the foam layer on at least two finite areas of the foam layer adjacent the leading edge, and means for applying the solvent for the polymer of the foam layer to a finite area in the form of a strip along the trailing edge, and means for rapidly moving the label around the container, with the finite areas at the leading edge of the foam layer lightly but securely tacking the foam layer to the container, and the finite area of the foam layer at the trailing edge forming a seam where it overlaps the outer surface of the the leading edge of label.

It is an object of the present invention to provide a method of labeling a container comprising, (a) providing a web of foamed polystyrene sheet material the width of which equals the axial dimension of a label on the container, one face thereof having label indicia, (b) moving the leading edge of the web to a rotating vacuum drum, (c) cutting a length of material from the web forming a label, said length being equal to the peripheral dimension of the label on the container, (d) holding the label on the drum with the one face adjacent thereto, (e) applying methylene chloride solvent in a finite area pattern on the other face of the label while on the drum, and (f) rolling a container along said other face of the label disposed exteriorly on the drum and thereby transferring the label to the container, whereas the areas of the said solvent application pattern cause the label to adhere to the surface of the container and to itself, whereby the container has a label of the thermoplastic material applied on its exterior surface.

These and other objects will be apparent from the specification that follows, the appended claims, and the drawings, in which:

Figure 1:
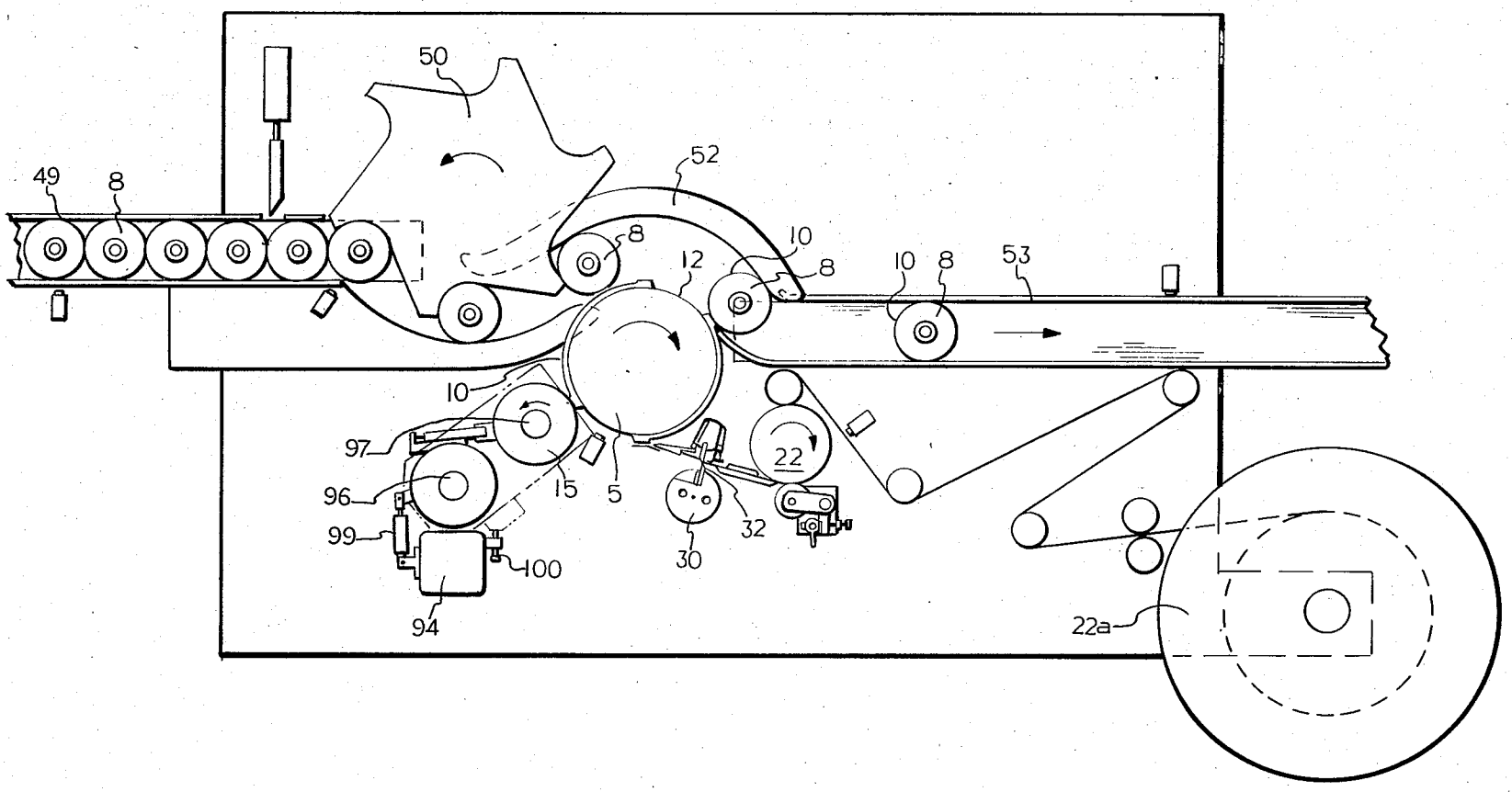
FIG. 1 is a schematic top plan view showing the apparatus and methods of the present invention in which plastic labels are wrapped around containers on a production basis using a solvent-sealing system.

The present invention provides, without the drawbacks accompanied by the use of hot-melt adhesive glues, an efficient, high production apparatus for continuously wrapping a polystyrene label around a container, the container having a body and the label comprising a solid polystyrene layer and a foam polystyrene layer, the label being wrapped around the body with the foam layer next to the body. The apparatus comprises: means to provide the label in sheet form towards a wrapping station in a continuous flow; means for cutting a desired length of material from the sheet to provide the label, the cutting being continuous to provide a plurality of the labels; means to move a leading edge of the label to the periphery of a rotating vacuum drum; means to keep the label on the drum periphery with the solid polymer layer next to the periphery; means for contacting the foam layer of the label with methylene chloride while moving toward the wrapping station, the contacting forming a finite area on each of the trailing and leading edges, the finite area consisting of a viscous, tacky solution of polystyrene in methylene chloride, capable of bonding lightly but securely the foam layer to the container body by rapidly solidifying the tacky solution, the bond between the body and the label becoming weaker as the solidifying solutions harden whereby after use, the label is easily and cleanly removed from the container so the container can be recycled, means for bonding the leading and trailing ends of the label together by overlapping the same and rapidly solidifying the viscous, tacky solution to form a solid cohesive bond between the ends of the foam layer and the overlapped solid polystyrene layer.

The present invention also provides an efficient and quick method of providing a label around a container having a body whereby the label is wrapped around the container and the plastic label comprises a foam polymer layer, the process comprising the steps of: (a) transporting toward a wrapping station a sheet of the plastic label stock whereby the transporting is continuous and the length axis of the stock is parallel to the horizontal; (b) cutting the stock to form a plurality of labels of a desired length; (c) moving the leading edge of the label to a vacuum drum; (d) placing and guiding the label on the periphery of the drum with one face next to the peripheral drum surface; (e) applying a low boiling, quick evaporating solvent for the polymer of the foam layer to the other side of the foam layer in at least two finite areas adjacent the leading edge of the label and in a finite area in the form of a strip near the trailing edge of the label to form a viscous tacky solution of the polymer in the solvent in each of the finite areas; (f) rapidly solidifying the tacky solution to form a solid cohesive; (g) rapidly rolling a container along the other side of the label to lightly but securely tack the rapidly solidifying finite areas of the leading edge to the body of the container to form a solid adhesive bond between the foam layer and the container, the bond between the label and the container becoming weaker after wrapping, whereby, after use, the label can be easily and cleanly stripped from the container so the container can be recycled, and (h) continuously rolling the container along the other side of the label and overlapping the trailing and leading ends of the label to form a seam by rapidly solidifying the tacky semi-solid solution in the finite area of the trailing edge to bond the overlapped ends together.

U.S. Pat. No. 3,468,467 to Amberg shows a two-piece plastic cup construction with a solvent seal for the side seam and solvent sealing the bottom in place. The Amberg patent discloses the use of methylene chloride as a solvent for use with the hard, dense polystyrene skin of the cup material. The sealing is performed fairly slowly and the use of pressure on the overlapped edges of the side seam, etc. is disclosed. The text of the Amberg patent contains in several places a prohibition against the use of the solvent in the foam area of the polystyrene material. For instance, see lines 14–20 in col. 2.

In sharp contrast, the present invention uses a solvent sealing system in which the solvent, methylene chloride, is applied directly to the foam polystyrene layer of a plastic label. The methylene chloride very quickly dissolves the polystyrene in the foam. The timing of the solidification of the resultant tacky solution is such that the foam layer can be lightly and securely tacked to the container surface by the solidifying solution within $\frac{1}{2}$ or preferably within $\frac{1}{3}$ or $\frac{1}{4}$ second so that it can be wrapped on a production basis. The methylene chloride is also applied to the trailing edge of the polystyrene label to form a finite area on the trailing edge that forms a side seam seal when the label ends are overlapped, the finite area being formed with a solidifying tacky solution of polystyrene in methylene chloride.

Figure 2:
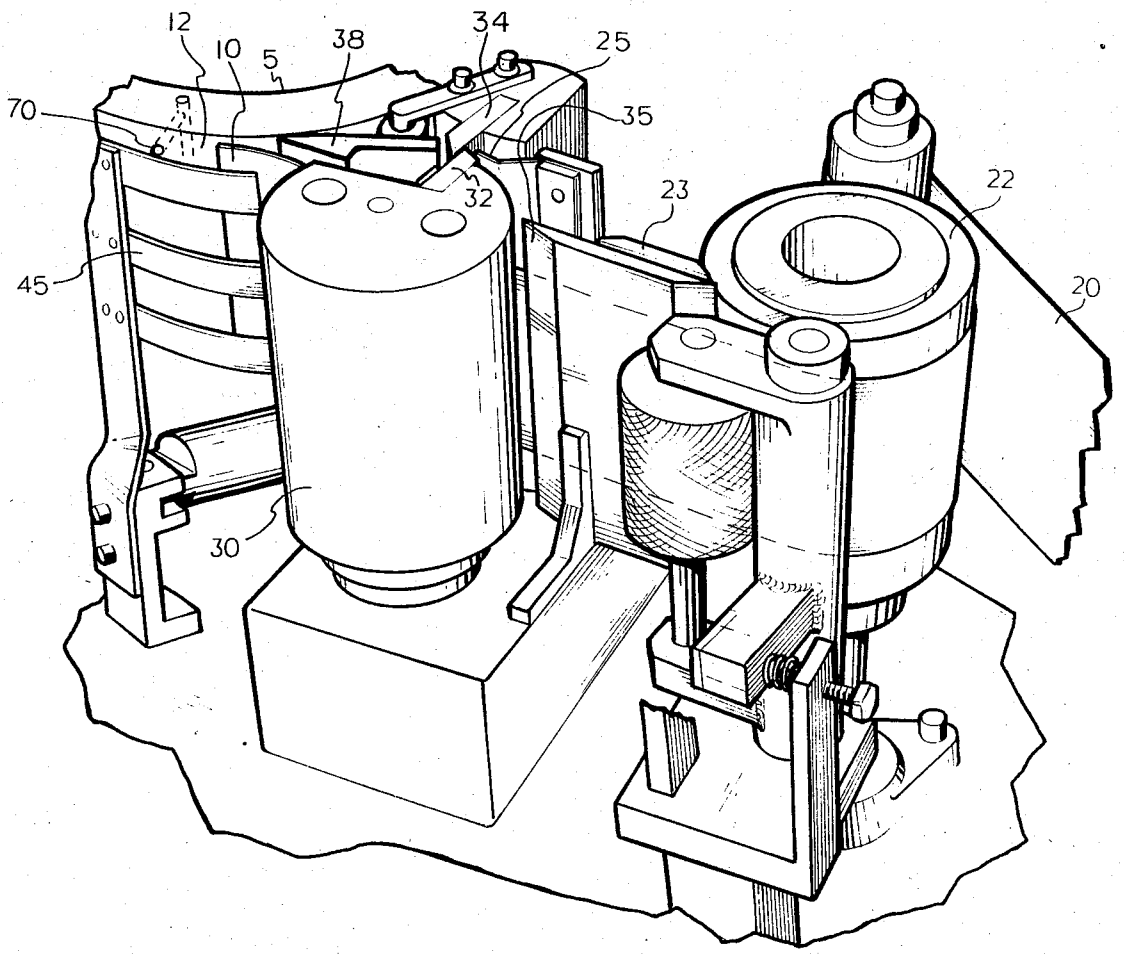
FIG. 2 is a fragmentary perspective view showing apparatus for the feeding of a plastic sheet to a cutting device for, the cutting of the sheet into labels and guiding the same to a vacuum drum in the label-wrapping station.
Figure 3:
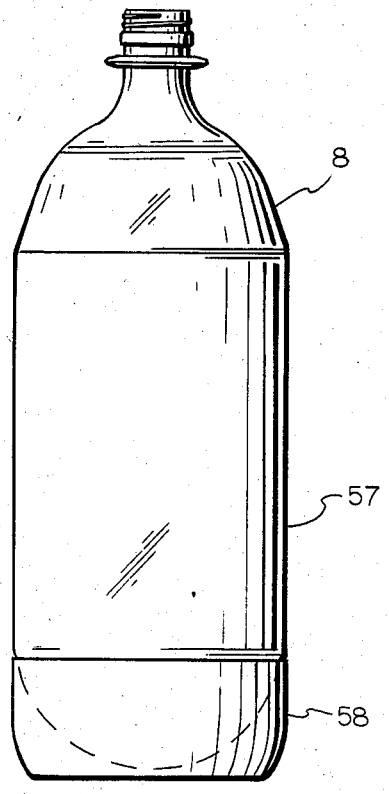
FIG. 3 is an elevational view showing a container in the form of an oriented plastic container with a base cup.
Figure 6:
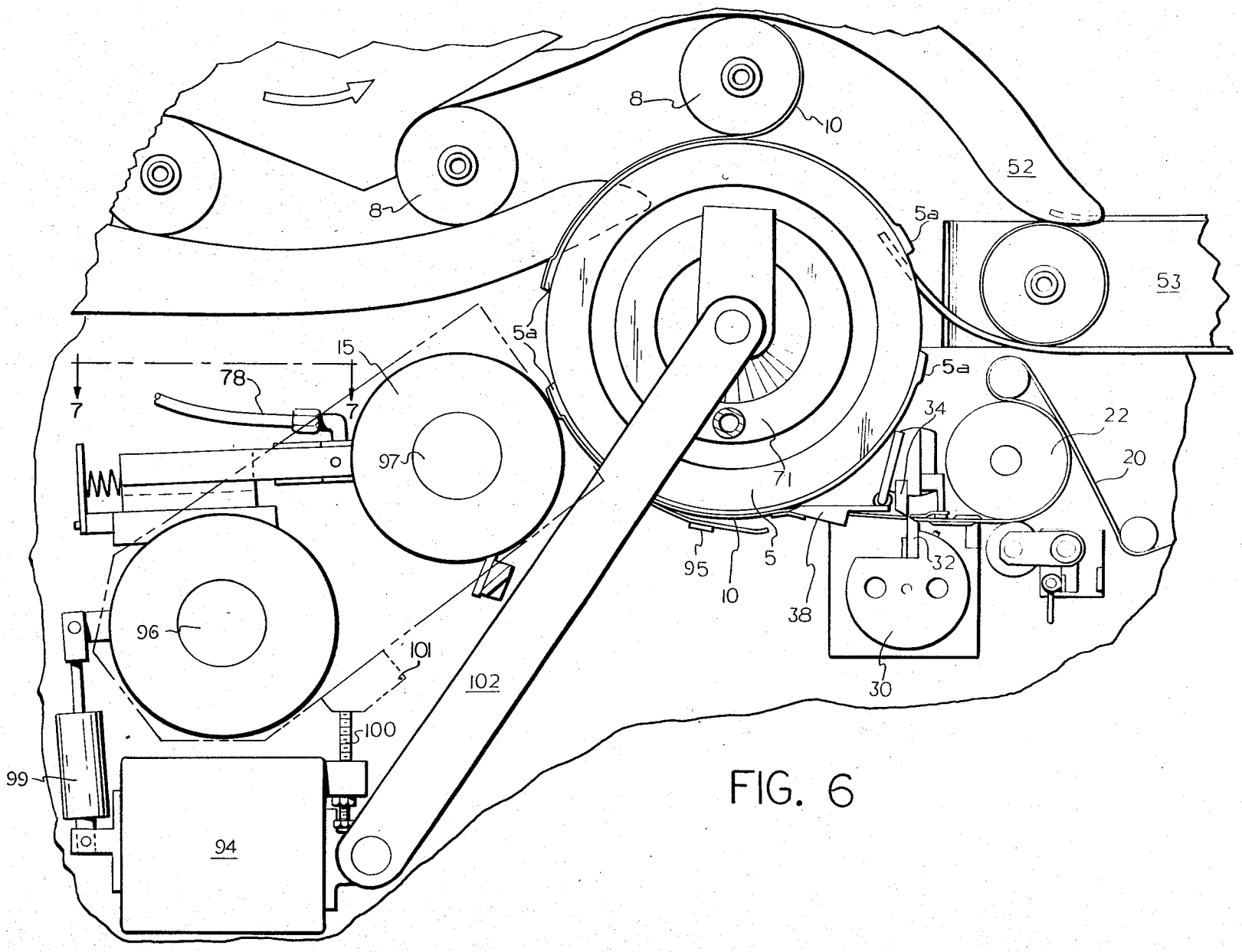
FIG. 6 is an enlarged fragmentary top plan view of a portion of the labeling apparatus of the present invention.

As seen in the drawings, such as FIGS. 1, 2 and 6, an apparatus is shown including a vacuum drum 5 as a part of a label-wrapping station for a container 8. A plastic label 10 is disposed around the periphery 12 of the vacuum drum 5. A gravure roll 15 applies solvent to one side of the label as it rotates around the vacuum drum just prior to being wrapped around the container.

As seen in FIGS. 1 and 2, a plastic label such as a coextruded sheet 20 having a solid polymer layer **20*a* and a foam polymer layer 21 is transported towards the label-wrapping station by a feed roll 22 from a supply roll 22*a***, the label sheet generally having its length axis substantially parallel to the horizontal.

There is provided a label guide 23 and a turning bar 25 mounted adjacent the outer periphery of a rotating member 30. The member 30 has a knife 32 mounted on its periphery for contacting the sheet 20 at the stationary knife 34 to cut the sheet 20 into desired lengths of a label 10.

The sheet 20 is guided by the action of the turning bar 25 and a primary feed guide 35 on the other side of the passing sheet. A secondary feed guide 38 guides the sheet 20 towards the periphery of the vacuum drum, and a final guide 45 directs and positions the leading edge of the sheet 20 (soon to be cut label 10) back on the vacuum drum, as vacuum is being pulled through vacuum ports 70. This is especially useful on the initial start-up.

As seen in FIG. 1 or FIG. 6, containers 8 are fed to the label applying station one by one along a conveyor 49, a starwheel 50 feeds the containers 8 one at a time along a fixed surface 52 spaced from the drum 5 whereby each of the containers rolls along a cut label 10 on the drum periphery 12 to wrap the label around the container. The wrapped containers move away from the labeling station on a conveyor 53.

Figure 8:
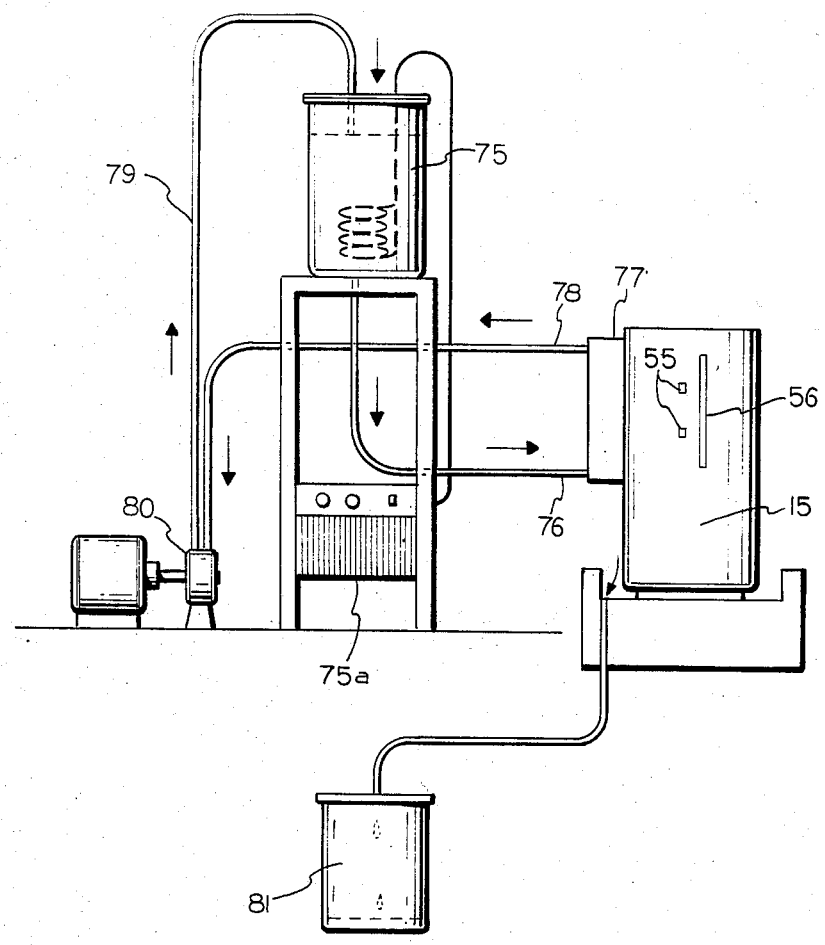
FIG. 8 is a diagrammatic view of the solvent-seal application system including the storage tank, the fountain, refrigeration unit and the gravure roll.

As seen in FIG. 8, a gravure roll 15 has indentations at 55 and 56 on its outer surface for accepting solvent for application to the label. The roll indentations areas 55 and 56 are for applying solvent to the foam layer of the label.

Figure 4:
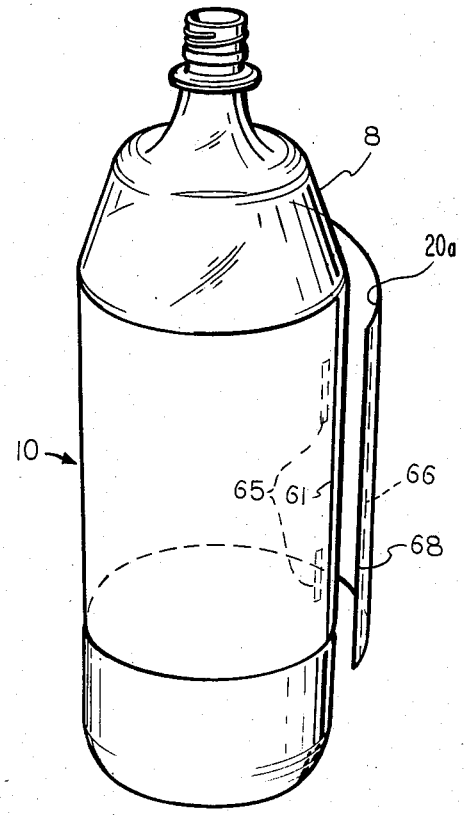
FIG. 4 is a perspective view showing the container of FIG. 3 with a plastic label being wrapped around the container.
Figure 5:
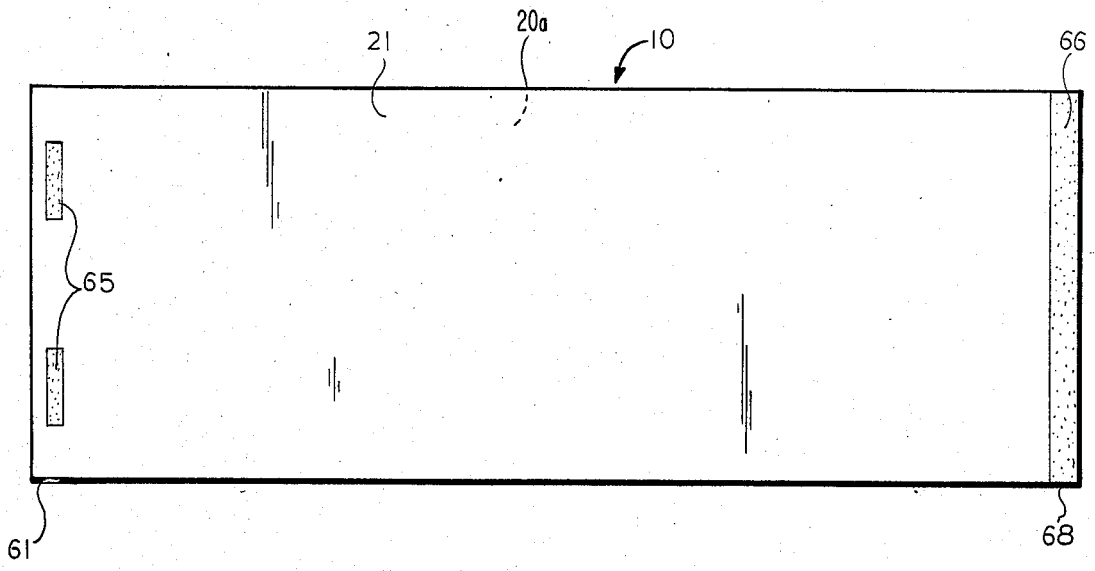
FIG. 5 is a top plan view of a plastic label with the foam layer having two spaced apart finite areas near its leading edge and a finite area in the form of a strip near the trailing edge.

As seen in FIG. 4, the container 8 with a body portion 57 and a base cup 58 is shown partially wrapped with the label 10 in FIG. 4. As seen the foam layer 21 is provided adjacent a leading edge 61 with two spaced-apart vertically aligned finite areas 65 on its leading edge 61. The finite areas 65 correspond to the areas 55 of the gravure roll. A finite area 66 in the form of a strip 66 is provided on the trailing edge 68, the finite area 66 corresponding to the area 56 of the gravure roll. The action of the gravure roll contacting the foam layer is very quick and must be accomplished in a high speed production system. The two finite areas 65 have been found very effective in anchoring the label to the container for wrapping. The finite areas 65 are formed by applying a solvent, methylene chloride, to the polystyrene label material which, upon contact, forms a tacky solution, the tacky bond being sufficient to enable the sticking of the label to the bottle. As previously indicated, the bond between the container and label becomes weaker, the bond not attacking or marring the container, such as any plastic, glass, metal or paper container. The label can be easily and cleanly removed later, before or after use (before use, such as to allow in-plant recycling of damaged containers), for recycling or reclamation.

As seen, for example, in FIGS. 1 and 6, there is shown means including guides 23, 38 and 45 for moving the leading edge 61 of the label sheet 20 to the periphery of the vacuum drum. Means for pulling a vacuum on the interior of the drum is provided, the vacuum being pulled from a plurality of ports 70 on the drum periphery, the ports communicating with the drum interior through a passageway thereto including a manifold 71. By the use of vacuum, each of the advancing labels is held on the rotating drum periphery with the printed side against the drum. The foam side 20*a* is quickly and efficiently contacted by this outer periphery surface of the gravure roll 15 to place solvent in the finite areas 65 and 66 of the label. The label is quickly moved by the drum into contact with a container 8 that is held by the fixed surface 52 where a label is rolled around the container to produce an excellent product that can be easily recycled.

Figure 7:
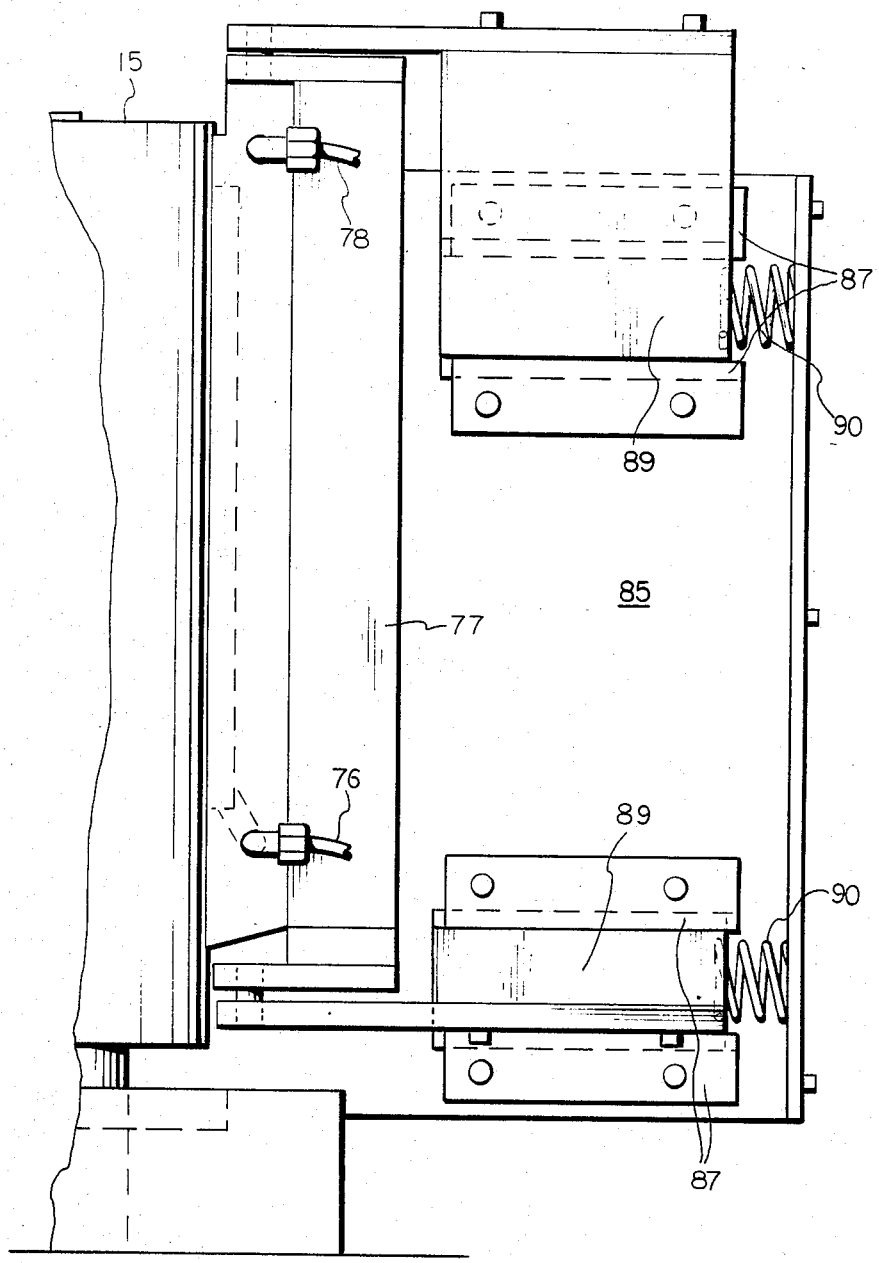
FIG. 7 is a fragmentary enlarged elevational view of a gravure roll and fountain taken along the line 7—7 of FIG. 6.

As seen in FIGS. 7 and 8, a closed system for furnishing solvent to the gravure roll 15 is shown. In the schematic drawing in FIG. 8, there is shown a supply tank 75 having a supply line 76 leading to a fountain 77, where, in the preferred embodiment, methylene chloride; preferably controlled at a temperature of about 52° to 58° F. by refrigeration unit 75*a*, is brought into the bottom portion of the fountain. The refrigeration means 75*a* shown in FIG. 8 is to control the solvent temperature.

The unused solvent from the fountain 77 is returned to the supply reservoir 75 through lines 78 and 79 by means of a pump 80. Thus, the supply of methylene chloride to the fountain 77 is advantageously accomplished by the use of gravity. The pump 80 keeps the solvent circulating back to the tank 75 keeping the system at the head pressure of the tank 75, only slightly above atmospheric, to reduce wear and tear and a possible hazard due to leakage of solvent.

The slight amount of overflow, if any, between the fountain and gravure roll is taken care of by gravity, any excess flowing into a closed reservoir 81.

As seen in FIG. 7, the fountain 77 supplies solvent to the gravure roll 15 by the rotating gravure roll rubbing against the fountain.

The fountain 77 is mounted on a support frame 85 comprising upper and lower bracket members 87. Movable upper and lower guide members 89 are slidingly mounted in the brackets 87, each guide 89 biasing the fountain 77 by means of springs 90 against the rotating gravure roll 15 to quickly and efficiently supply solvent to the gravure roll. The rotating member 30, the rolls 22 and 15 are driven by conventional shafts, gears and the like (not shown). As seen in FIG. 6, the vacuum drum provides the drive means for shaft 96 which in turn drives gravure roll shaft 97. The shaft 96 is connected underneath the apparatus to a suitable drive means from the vacuum drum 5 as well as roll 22 and rotating member 30, etc.

As seen in FIG. 6, gravure roll 15 and its assembly is pushed into position adjacent the vacuum drum by an air cylinder 99. The gravure roll assembly pivots about the axis of shaft 96 and is held in place on one side by an adjustable bolt 100 and a stop member 101. As the vacuum drum 5 rotates, the material on this periphery 12 of drum 5 has its leading and trailing edge on a raised pad 5A which comes in contact with gravure roll 15. Thus, the finite areas 55 and 56 on the gravure roll contact the leading and trailing edge portions; whereupon the solvent is applied. An arm 102 is provided to keep the manifold 71 of the drum 5 stationary and in place while the drum 5 and roll 15 rotate.

The apparatus and methods provide a labeled container that can be produced continuously and economically, the seam of the label being one that becomes stronger and able to withstand any force normally encountered to tend to pull the seam apart. The adhesive bond between the container and the label is just enough to keep the label on the container, but advantageously can be easily removed to provide a clean container for recycling.

What is claimed is:

1. In apparatus for wrapping a plastic label about a bottle and adhering the label to the bottle, where the label is a composite sheet of a solid polymer layer and foam polymer layer with the foam layer being applied to the bottle surface, the improvement comprising, just before wrapping, means for applying a solvent for the polymer of the foam polymer layer to at least two finite areas of the surface of the foam layer with one area adjacent the leading edge of the label and the other area constituting a full height strip along the trailing edge of the label the solvent dissolving the polymer of the foam layer rapidly to form a momentary tacky bond at the finite areas of the leading edge sufficient to tack the label to the container, the leading edge bond becoming weaker and weaker as the solvent evaporates, and means for rolling a bottle along the solvent treated label with the leading edge momentarily tacked to the bottle and the trailing edge bonding to itself to form an overlapping seam in which the trailing edge finite area bond becomes stronger and stronger, wherein said means for applying a solvent to the label comprises a rotating gravure roll having at least two areas of indentation in its surface, with each area being circumferentially spaced from the other a distance slightly less than the full length of a label, means for moving the foam surface of the label into engagement with the gravure roll, and means engaging the gravure roll surface for applying the solvent to the areas of indentation in said gravure roll, said solvent supplying means further comprises an elevated container for said solvent, means for cooling the solvent in said container, means connecting the bottom of said solvent container to the bottom of said fountain and means connected to the top of said fountain for returning excess solvent from said fountain to said elevated container.

2. In apparatus for applying labels to the cylindrical body of containers wherein the labels are individually cut from a moving web of a film-foam laminate of a thermoplastic polymer and carried by a vacuum drum from the cutting zone to a label applying zone, the improvement comprising means for applying a solvent for the polymer to at least two finite areas of the foam side of the label as it is being carried on the drum with the two areas being spaced apart such that one is adjacent the leading edge of the label and the other is a strip covering the trailing edge the solvent dissolving the polymer of the foam layer rapidly to form a momentary tacky bond at the finite areas of the leading edge sufficient to tack the label to the container, the leading edge bond becoming weaker and weaker as the solvent evaporates, there being means to wrap the label around the container while the leading edge bond is tacky enough to secure the label to the container sufficiently to anchor the leading edge thereto for wrapping, the bond formed by the tacky solution of the polymer in the solvent in the wrapped overlapped ends becoming stronger and stronger after wrapping, wherein said means for applying solvent comprises a gravure roll, rotatable about a vertical axis, with its periphery engaging the label carried by the drum, and further comprising a vertical fountain engaging said roll with means for supplying solvent to said fountain, said solvent supplying means further comprises an elevated container for said solvent, means for cooling the solvent in said container, means connecting the bottom of said solvent container to the bottom of said fountain and means connected to the top of said fountain for returning excess solvent from said fountain to said elevated container.

3. In a method of providing a label around a container having a body whereby the label is wrapped around the container and the plastic label comprises a foam polymer layer, the method comprising the steps of:

A. transporting toward a wrapping station a sheet of the plastic label stock whereby the transporting is continuous and the length axis of the stock is parallel to the horizontal;

B. cutting the stock to form a plurality of labels of a desired length;

C. moving the leading edge of the label to a vacuum drum;

D. placing and guiding the label on the periphery of the drum with the top face next to the peripheral drum surface; and E. wrapping the label around the container, the improvement comprising:

F. just before wrapping, applying a low boiling, quick evaporating solvent for the polymer of the foam layer to the underside of the foam layer in at least a finite area adjacent the leading edge of the label to form a momentary tacky bond that is a viscous tacky solution of the polymer in the solvent in the finite area, the bond between the label and the container becoming weaker and weaker after wrapping, whereby the label can be easily and cleanly stripped from the container so the container can be recycled; and G. applying the solvent to a finite area of the trailing edge to form a solid adhesive bond between the foam layer and the overlapped end of the label, the bond at the overlapped ends becoming stronger and stronger.

4. A method as defined in claim 3 in which there are the steps of: supplying methylene chloride to a fountain, providing a gravure roll with an indented area to correspond to the finite areas to be made in the foam layer, supplying methylene chloride to the indented areas, and lightly contacting the foam layer against the gravure roll to apply methylene chloride to the foam layer to form in each of the finite areas a momentary tacky solution of the polymer in methylene chloride.

5. A method as defined in claim 3 in which the solvent when applied becomes a very tacky solution in less than about ½ second.

6. A method as defined in claim 3 further comprising the step of controlling the temperature of the solvent to about 55° F.

7. A method as defined in claim 3 in which the container is a biaxially oriented polyethylene terephthalate carbonated beverage bottle.

8. A method as defined in claim 3 in which the label is a coextruded label having a solid polymer layer with printing indicia thereon and a foam polystyrene layer that is next to the container when wrapped.

9. A method as defined in claim 3, in which the step of applying methylene chloride solvent is by providing a gravure roll with indented areas corresponding to the finite areas to be made in the foam layer, and lightly contacting the foam layer against the gravure roll to apply the methylene chloride to the foam layer in the finite areas, thereby forming a momentary tacky solution of the polymer in methylene chloride.

10. A method as defined in claim 9 in which there is an additional step of controlling the temperature of the methylene chloride within the fountain to about 52° to 58° F.

* * * * *